United States Patent [19]

Lewis

[11] 4,043,469

[45] Aug. 23, 1977

[54] APPARATUS FOR PROTECTING OVERHEAD CABLES

[76] Inventor: Daniel D. Lewis, R.D. 1 Sunnyside, Glens Falls, N.Y. 12801

[21] Appl. No.: 644,503

[22] Filed: Dec. 29, 1975

[51] Int. Cl.[2] ..... E02F 3/32

[52] U.S. Cl. ..... 214/138 R; 212/139 P

[58] Field of Search ..... 214/138 R, 145 R, DIG. 7, 214/DIG. 11, DIG. 12, 761; 212/39 P, 144; 242/157 R

[56] References Cited

U.S. PATENT DOCUMENTS

| | | | |
|---|---|---|---|
| 2,263,978 | 11/1941 | Branovic et al. | 214/DIG. 7 |
| 2,989,194 | 6/1961 | Thomas | 212/39 P |
| 3,187,913 | 6/1965 | Strader et al. | 214/761 |
| 3,570,691 | 3/1971 | Guinot | 214/138 R |
| 3,796,335 | 3/1974 | Smith et al. | 214/761 |
| 3,934,679 | 1/1976 | Lieptz | 214/DIG. 7 |

*Primary Examiner*—Robert J. Spar
*Assistant Examiner*—Ross Weaver
*Attorney, Agent, or Firm*—Paul I. Edelson

[57] ABSTRACT

Apparatus for use in conjunction with material handling equipment to provide for protection of overhead cables from damage by such material handling equipment being operated thereunder is disclosed. Material handling equipment having pivotably connected arms and hydraulic means for causing relative motion between such arms about their pivot point is provided with a substantially continuous bumper comprising at least two guard members. One end of a first guard member is attached to one arm and one end of a second guard member is attached to the arm pivotably connected to the first arm. A sheath slidably receiving the second end of one guard member is provided to provide for bumper length adjustment as the arms pivot. The second end of the other guard member is so disposed to complete a substantially continuous bumper. Various modes of attachment are employed in several embodiments of this invention.

11 Claims, 4 Drawing Figures

10
11
12
13
14
15
16
17
18
19
23
25
34
35
36
37
51
52
53
61
62
81
82
83
84
91
92
101
102
103
104
301
302
303
304
401
402
403
404

APPARATUS FOR PROTECTING OVERHEAD CABLES

This invention relates to material handling equipment. More particularly, this invention relates to a bumper structure for material handling equipment to protect overhead cables from damage by such material handling equipment being operated therebelow.

In the operation of certain types of material handling equipment, difficulties have been experienced in working in the vicinity of overhead cables such as power lines, telephone lines, and television cables. In particular, construction equipment having elevatable booms such as loaders, cranes, and backhoes, when employed in construction projects to be performed in the vicinity of preexisting overhead cable runs, have a tendency to inadvertently come into interferring contact with such cables. Material handling equipment currently employed does not present a smooth surface, but on the contrary, presents a discontinuous and irregular surface containing protruding pivots, mounting brackets, hydraulic lines and fittings, hydraulic actuators, protruding bolts, and other such like features providing sharp discontinuities upon which an overhead cable is likely to become snagged when contacted by a member of such material handling equipment. A line which becomes so snagged or entangled will almost invariably be broken resulting in a substantial repair expense which must usually be borne by the individual responsible for the operation of the equipment. For example, a snagged and broken television cable typically results in repair costs of approximately $350.00 dollars. Additionally, a personnel hazard also exists when such material handling equipment is operated in the vicinity of overhead power lines. A broken power cable presents an obvious shock hazard to personnel. Additionally, an uninsulated power cable, even if not broken, presents a significant personnel hazard if contacted by, for example, the uninsulated boom of a backhoe.

As a result of the difficulties outlined above which have been experienced in operating material handling equipment in the vicinity of overhead cables, it has become a common practice in the construction industry to work extremely carefully and gingerly in the vicinity of overhead cables. In practice, therefore, machine operators tend to spend more time in judging angles and distances, and also operate the arms of their machines more slowly in the vicinity of cables than they would otherwise. This significantly extends the time required to complete a given construction operation, and, nevertheless, cables continue to be destructively snagged despite the taking of all reasonable precautions in the operation of machines.

It is, accordingly, an object of this invention to provide a bumper or deflector mechanism for use with material handling equipment to protect overhead cables from damage by such material handling equipment.

It is another object of this invention to provide such apparatus having an electrically insulating external surface to provide for protection of personnel from electrical shock hazard.

It is another object of this invention to provide such apparatus which is inexpensive to manufacture and simple and inexpensive to install on material handling equipment of various types and manufactures.

It is another object of this invention to provide such apparatus wherein the electrically insulating members may be simply and quickly replaced.

Briefly, and in accordance with one embodiment of this invention, material handling equipment having provotably connected arms and hydraulic means for causing relative motion between such arms about their pivot point is provided with a substantially continuous bumper comprising at least two guard members. One end of a first guard member is attached to one arm and one end of a second guard member is attached to the arm pivotably connected to the first arm. A sheath slidably receiving the second end of one guard member is provided to provide for bumper length adjustment as the arms pivot. The second end of the other guard member is so disposed to complete the substantially continuous bumper.

The novel features of this invention sought to be patented are set forth with particularity in the appended claims. The invention, together with further objects and advantages thereof, may be understood from a reading of the following specification and appended claims in view of the accompanying drawings in which:

Figures 1, 3, 4:
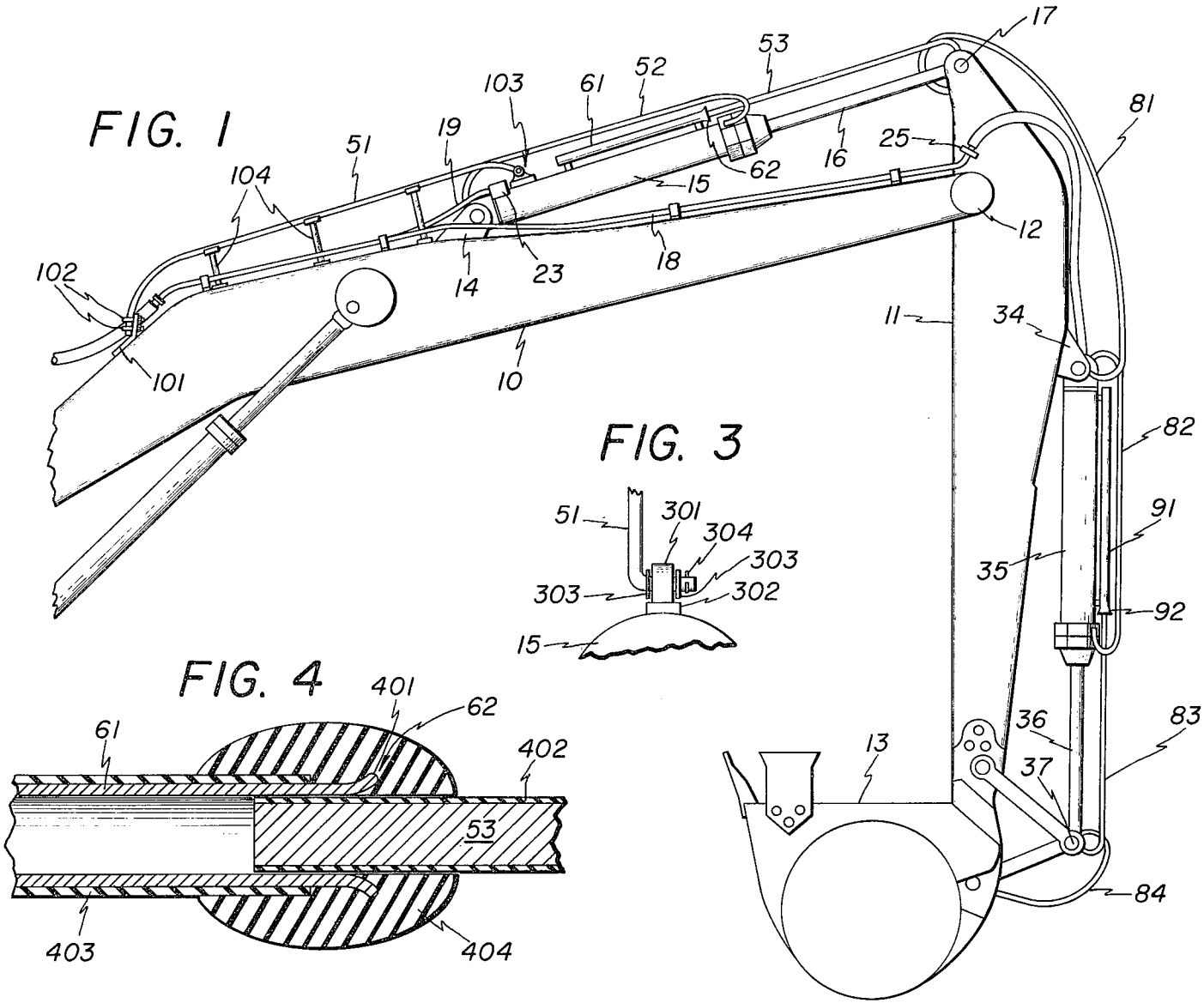
FIG. 1 is a side elevation view of a bumper in accordance with this invention installed on the boom and dipperstick members of a backhoe.
FIG. 3 is an elevation view of the means for attaching a guard member of the bumper of this invention to a member of the bumper of this invention to a member of the material handling equipment in accordance with one embodiment of this invention.
FIG. 4 is an enlarged cross-sectional view illustrating a detail of the structure of FIG. 1.
Figure 2:
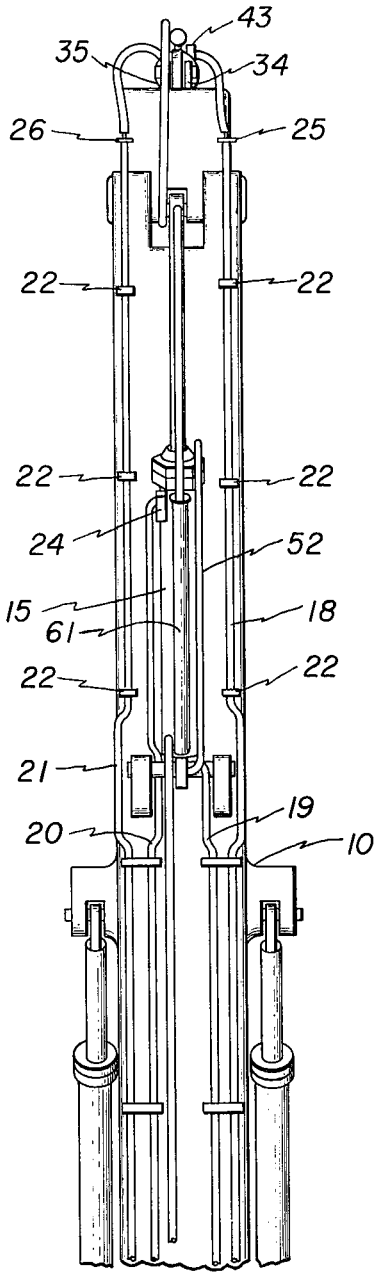
FIG. 2 is a top plan view of the bumper in accordance with this invention installed on the backhoe members of FIG. 1.

FIG. 1 is a side elevation view and FIG. 2 is a top plan view showing the bumper of this invention operatively installed on a backhoe, said backhoe having a boom 10 and a dipperstick 11 pivotably connected at pivot 12. Dipperstick 11 carries bucket 13 journaled at the end thereof. Boom 10 has mounting bracket 14 for pivotably attaching hydraulic cylinder 15 which acts on ram 16 thereto. Ram 16 is connected to dipperstick 11 at pivot 17. Cylinder 15 and ram 16 effectuate relative movement between boom 10 and dipperstick 11 about pivot 12.

Boom 10 also carries hydraulic lines 18, 19, 20, and 21 which are held in position by retainer members 22. Hydraulic lines 19 and 20 feed cylinder 15 through hydraulic fittings 23 and 24 respectively.

Similarly, dipperstick 11 has mounting bracket 34 for pivotably attaching hydraulic cylinder 35 which acts upon ram 36 thereto. Cylinder 35 and ram 36 drive bucket 13. Hydraulic lines 18 and 22 are coupled to flexible sections respectively at fittings 25 and 26 and pass across from boom 10 to dipperstick 11 in the vicinity of pivot 12. Line 18 drives cylinder 35 through fitting 43 and line 21 drives cylinder 35 at the opposite end thereof through another fitting, not shown.

Material handling equipment such as the backhoe shown may thus be seen to have numerous protruberances upon which overhead cables can become snagged. Particularly, mounting brackets 14 and 34 and the pivot pins associated therewith, cylinders 15 and 35, hydraulic fittings such as 23, 24, 25, 26, and 43, retaining means 22, protruding bolts such as those shown at the forward end of cylinder 15, and the pivot, 17, end of dipperstick 11 have been found to present particular hazards to overhead cables. Another difficulty in working closely under overhead cables results from the fact that the elevation of cylinders 15 and 35 over boom 10 and dipperstick 11 respectively is a function of the extension of rams 16 and 36. The height of the highest point on the equipment structure is therefore a complex function and very difficult for the equipment operator to judge precisely.

Therefore, in accordance with this invention, a bumper structure is provided for material handling equipment to present a smooth, continuous, deflecting surface interposed between the equipment elements and any overhead cables so that any cables contacted will be guided away from the underlying equipment member and will not become snagged and broken. A bumper structure in accordance with this invention is shown installed on the backhoe of FIGS. 1 and 2 and comprises first, second, and third guard members 51, 52, and 53, disposed over boom 10 and guard members 81, 82, 83, and 84 disposed over dipperstick 11. The guard members may be formed of any suitably strong, nonbrittle material and may be of any shape which provides a substantially continuous, smooth, non abraisive, noncutting surface. For example, in an embodiment of this invention which has provided satisfactory results, the guard members were formed from $\frac{7}{8}$ inch diameter steel rod stock. In that embodiment, in order to provide electrical insulation for personnel protection as heretofore described, one inch inner diameter PVC pipe was installed over the $\frac{7}{8}$ inch rod stock guard members. Because insulating materials tend to be subject to damage by abrasion, the use of tube stock which can be slipped over the guard members, and slipped off for replacement when needed, is preferred, but this invention is not so limited and any suitable electrically insulating coating known in the art may be applied to the outer surface of the guard members.

In order to provide a bumper of variable length to conform to the dimensions of the elements of the machine as rams 16 and 36 are moved, guard members 53 and 83 are slideably received in sheath members 61 and 91 respectively. Sheath members 61 and 91 are preferably formed of a strong, rigid, material. In the embodiment just described, sheath members 61 and 91 were formed of 1 $\frac{1}{2}$ inch inner diameter metal pipe. Because some deflection of guard members will occur when they are in contact with heavy cables, the ends, 62 and 92 of sheath members 61 and 91 receiving respectively guard members 53 and 83 are preferably flared slightly into a bell mouth form to aid in guiding and straightening the guard members. Sheath members 61 and 91 are supported above cylinders 15 and 35 respectively on struts and are rigidly attached to the cylinders by any convenient means known in the art, as for example, by welding.

The guard members may be attached to the equipment structure at various points and in various modes in accordance with various embodiments of this invention. Guard member 51 is attached at a first end thereof to boom 10 by mounting bracket 101 and U-bolts 102. Bracket 101 is any suitable angle brackets, preferably metalic, and is attached to boom 10 by any suitable means, as for example, welding. The other end of guard member 51 is attached to cylinder 15 by a pivot attachment means indicated generally at 103 and illustrated in detail in FIG. 3. As shown in FIG. 3, the end of guard member 51 is bent at essentially a right angle and passed through bearing tube 301. Tube 301 is attached to mounting plate 302 by any convenient means and mounting plate 302 is rigidly attached to the outer surface of cylinder 15, as by welding. The end of guard member 51 is held in place in bearing tube 301 by any convenient means known in the art, as for example by washers 303 and cotter pin 304. The use of pivot connection 103 is preferred in the case of any guard member whose opposite ends terminate on equipment elements subject to relative angular motion, such as in the case of guard member 51 whose ends terminate respectively on boom 10 and on cylinder 15. The degree of movement between an arm member such as boom 10 or dipperstick 11 and the cylinder associated with it, 15 and 35 respectively, is not so great as to unduly buckle a guard member attached therebetween, but is sufficient to unduly fatigue such guard member if a pivotable termination is not provided.

An alternative to the pivotable attachment 103 of guard member 51 is illustrated with reference to the corresponding guard member 81 on dipperstick 11. A first end of guard member 81 is attached to dipperstick 11 on an inner surface thereof adjacent pivot 17. The other end of guard member 81 is fixedly attached to mounting bracket 34. Since mounting bracket 34 does not move relative to dipperstick 11 a pivotable attachment such as 103 is not required.

The demountable attachment means comprising bracket 101 and U-bolts 102 illustrated at one end of guard member 51 is employed to provide for the replacement of electrically insulating tubing members used over the guard member. In the embodiment heretofore described, it was found to be a very quick and simple procedure to loosen U-bolts 102, lift the end of guard member 51 free of equipment structure, slip off the insulating PVC tubing which had become abraded through use, slip on a replacement PVC tubing, and reattach the guard member through U-bolts 102. The use of pivot termination 103 at the other end of guard member 51 facilitates the process since guard member 51 can be moved to any convenient angle for the replacement of the tubing. However, it has been found, at least for the embodiment employing $\frac{7}{8}$ inch steel rod guard members, that the pivot 103 is not necessary for this purpose. The guard member itself has sufficient flexibility to allow for the replacement of the PVC tubing. If, on the other hand, an alternative material, or an alternative shape having less flexibility is used for the guard members, the use of a pivot termination may be required to allow for the replaceability of the insulating tubing. This is a matter of design choice.

Since some deflection of guard members will occur upon contact with a heavy cable, support struts 104 may be provided to prevent guard member 51 from being deflected to a point too close to boom 10. Struts 104 are preferably welded directly to boom 10 at their lower ends and have trough-like upper portions for supporting guard member 51. In the embodiment employing $\frac{7}{8}$ inch steel rod stock, no supporting struts were found to be required.

Guard member 52 is attached to opposite ends of cylinder 15. One end of guard member 52 is preferably attached by bracket and U-bolt means such as illustrated with reference to guard member 51 to facilitate replacement of an electrically insulating tubing member as discussed above. However, where the use of replaceable electrically insulating tubing is not desired, and this invention is not to be considered so limited, guard members may be fixedly attached at both ends as illustrated by guard member 52. In accordance with a preferred embodiment of this invention, guard member 52 overlaps guard member 51 and the overlapping ends of guard members 51 and 52 are so configured to provide continuity of the bumper surface along the area of overlap as equipment members move relative to one another. Guard member 52 overlies sheath member 61 and the junction 62 between sheath 61 and guard member 53. Guard member 52 therefore serves to prevent sheath member 61 from interfering with overhead cables. Similarly, guard member 82 functions cooperatively with guard member 81 in providing a continuous bumper surface and in providing protection for cylinder 35 and sheath member 91.

Dipperstick 11 is also provided with guard member 84 which is disposed overlappingly with guard member 83 at the junction of ram 36 and bucket journal pivot 37 to extend the cable protective bumper surface over the arms controling bucket 13.

FIG. 4 is an enlarged sectional view of the end 62 of sheath member 61 showing guard member 53 received therein and illustrating construction details in accordance with several embodiments of this invention. The end 62 of sheath member 61 has flared portion 401 forming a bell mouth to aid in guiding and straightening guard member 53 in the event that guard member 53 becomes deflected as discussed above. The flared portion 401 provides a surface discontinuity which might interfere with an overhead cable. In the embodiment of this invention described above, such interference is prevented by guard member 52. In the embodiment of this invention in which guard members, such as 53, are surrounded by electrically insulating tube stock, shown at 402 in FIG. 4, the flare 401 at the end of sheath member 61 is absolutely necessary since, in its absence, insulating tube 402 would be destroyed by the slightest deflection of guard member 53 contemporaneous with guard member 53 being slid into sheath member 61. FIG. 4 also illustrates insulating material 403 applied to the outer surface of sheath member 61.

An alternative embodiment of this invention is also illustrated in FIG. 4. In accordance with this alternative embodiment, a quantity of somewhat flexible electrically insulating material 404 is disposed around end 62 of sheath member 61 and is shaped to provide a smooth surface in cooperation with sheath member 61 and guard member 53. The flexibility of material 404 allows flare 401 at the end of sheath member 61 to perform its function of straightening and guiding guard member 53, and at the same time, material 404 prevents cables from becoming snagged on flares 401. In accordance with one embodiment of this invention, the structure including material 404 shown in FIG. 4 is provided at both ends of sheath member 61, sheath member 61 is supported at a greater height above cylinder 15 than that shown in FIG. 1; particularly sheath member 61 is supported at essentially the height of guard member 52, guard member 52 is eliminated, and guard members 51 and 53 both terminate in sheath member 61 thereby providing a smooth bumper surface comprising guard member 51 sheath member 61 and guard member 53. This embodiment is not preferred because it is less easily maintainable than the embodiment heretofore described, but is within the scope of this invention.

Additional advantages provided by the protective mechanism of this invention include protection of hydraulic rams such as 16 and 36 from electrical damage upon contact with power cables. The surface of a hydraulic ram is machined to a high degree of smoothness and the ram operates through seals at the end of its associated cylinder. Upon contact with an uninsulated power cable an electrical arc to a ram will occur which will put a minor scratch on the surface of the ram. Continued operation of a ram in scratched condition can destroy the seals at the end of the associated hydraulic cylinder, resulting in costly and time consuming repairs. It has also been found in operation that the bumper mechanism of this invention serves to protect ram 36 on dipperstick 11 from mechanical damage when digging by providing the operator of the equipment with an additional visual guide to the position of the equipment elements.

While this invention has been described with reference to particular embodiments and examples, other modifications and variations will appear to those skilled in the art, in view of the above teachings. Accordingly, it should be understood that within the scope of the appended claims, the invention may be practiced otherwise then is specifically described.

The invention claimed is:

1. Apparatus for use in connection with material handling equipment having pivotably connected arm members and hydraulic members for moving said arm members, said hydraulic members having connection points on said arm members, said apparatus providing for protection of overhead cables from damage by said arm members and said hydraulic members, said apparatus comprising:

at least two smooth guard members, each said guard member having first and second ends;

means for attaching said first end of a first of said guard members to a first arm member;

means for attaching said first end of a second of said guard members to a second arm member; and means attached to one of said members slidably receiving at least one of said second ends for forming in co-operation with said guard members a substantially continuous bumper overlying said hydraulic means and at least a portion of said arm members.

2. Apparatus as claimed in claim 1 wherein at least one of said means for attaching more particularly comprises:

a bracket member affixed to one of said arm members; and means for releasably clamping said first end of one of said guard members to said bracket member.

3. Apparatus as claimed in claim 1 including additionally electrically insulating material disposed about the outer surfaces of said guard members.

4. Apparatus as claimed in claim 1 wherein said guard members more particularly comprise metal rod members.

5. Apparatus as claimed in claim 4 including additionally electrically insulating material disposed about the outer surface of said metal rod members.

6. Apparatus as claimed in claim 5 wherein said electrically insulating material more particularly comprises PVC tubing.

7. Apparatus as claimed in claim 1 including additionally:

a third smooth guard member having first and second ends, said first end of said third guard member being attached to a first end of one of said hydraulic members, said second end of said third guard member being attached to a second end of said one hydraulic member, said third guard member overlying said means slidably receiving and a portion of said second guard member.

8. The apparatus of claim 7 wherein a portion of said third guard member overlaps a portion of said first guard member, said overlapping portions being curved to provide a continuously smooth bumper as said equipment members to which said guard members are attached pivot with respect to each other.

9. Apparatus as claimed in claim 1 wherein said means slidably receiving more particularly comprises:

a hollow generally cylindrical member having an inner surface conforming in shape to said second guard member, said generally cylinderical member having at least one outwardly flared end portion.

10. The apparatus of claim 9 including additionally electrically insulating material disposed about the outer surfaces of said guard members and said means slidably receiving.

11. The apparatus of claim 10 including additionally a quantity of flexible electrically insulating material surrounding said flared end portion.

* * * * *